US005167572A

United States Patent [19]

Etkin

[11] Patent Number: 5,167,572

[45] Date of Patent: Dec. 1, 1992

[54] AIR CURTAIN FUME CABINET AND METHOD

[75] Inventor: Bernard Etkin, North York, Canada

[73] Assignee: Aerospace Engineering and Research Consultants Limited, Downsview, Canada

[21] Appl. No.: 660,814

[22] Filed: Feb. 26, 1991

[51] Int. Cl.[5] ..... B08B 15/02

[52] U.S. Cl. ..... 454/57; 454/191

[58] Field of Search ..... 98/36, 115.3

[56] References Cited

U.S. PATENT DOCUMENTS

| | | | |
|---|---|---|---|
| Re. 27,566 | 1/1973 | Simons | 98/115.3 X |
| 1,173,555 | 2/1916 | Caldwell | 98/36 |
| 3,625,133 | 12/1971 | Hayashi | 98/36 |
| 3,880,061 | 4/1975 | Hensiek et al. | 98/36 |
| 4,050,368 | 9/1977 | Eakes | 98/36 X |
| 4,915,622 | 4/1990 | Witmer | 98/36 X |
| 4,927,438 | 5/1990 | Mears et al. | 98/115.3 X |

FOREIGN PATENT DOCUMENTS

| | | | |
|---|---|---|---|
| 139128 | 5/1985 | European Pat. Off. | 98/115.3 |
| 2917853 | 11/1980 | Fed. Rep. of Germany . | |
| 46-29214 | 8/1971 | Japan | 98/36 |
| 1518438 | 1/1981 | United Kingdom . | |

*Primary Examiner*—Harold Joyce

*Attorney, Agent, or Firm*—Bereskin & Parr

[57] ABSTRACT

An air curtain fume cabinet, in which an air curtain jet is directed across the face opening to an exhaust duct. Sufficient flow is exhausted at the exhaust duct to swallow (i) the entire air curtain jet, plus (ii) all of the air which the jet entrains from outside the face opening, plus (iii) a substantial additional amount of air. This greatly increases the velocity of air moving into the curtain at its top, beyond the normal entrainment velocity, and prevents spill-back of jet air to the outside even with substantial crosswinds. Preferably the ratio of exhaust flow to jet flow is between 2 and 3 for a jet height to jet thickness ratio of up to about 15. Preferably auxiliary air is supplied to the working space interior to replace air entrained into the jet from inside the working space.

14 Claims, 12 Drawing Sheets

AIR CURTAIN FUME CABINET AND METHOD

FIELD OF THE INVENTION

This invention relates to a fume cabinet and to a method of operating a fume cabinet.

BACKGROUND OF THE INVENTION

Fume cabinets are usually used to isolate experiments or tests from the environment and from the experimenter. In particular, they are usually used to protect the experimenter from emissions produced by the test process, to protect the experiment or test from contamination by unwanted gases, particulates or bacteria, and to protect the environment from the products of the test process.

Conventional fume cabinets currently in use are generally based on the "counterflow" principle. In such cabinets the test or experiment is usually located in a space which is enclosed except for a large front opening to allow the experimenter access to the test or experiment. Air is drawn into the cabinet through the front opening, and the air flow into the cabinet is supposed to prevent contaminants in the cabinet from travelling outwardly through the front opening.

In such counterflow fume cabinets, the physical mechanisms available for transport of contaminant gasses outwardly through the front opening are molecular and turbulent diffusion. When the air flow into the front opening is strictly laminar, only molecular diffusion occurs, and calculations of molecular concentration show that it falls off rapidly with upstream distance. With a typical value of the binary diffusion coefficient, and an airflow into the cabinet front opening of about one metre per second, the contaminant concentration may typically decrease as much as six orders of magnitude in an upstream distance of only one millimeter. Thus, it is easy in an ideal laminar flow situation to ensure a negligible concentration upstream of the plane of the cabinet front opening (usually called the "face"). The net result is similar for particulates, although the physical mechanism for transport of particulates is quite different.

However the actual realization of the counterflow principle in practical fume cabinets is far from ideal. Typically there is a moveable sash at the top of the face which partially obstructs the entry; the exhaust from within the fume cabinet is from the top instead of from the back; the air exterior to the cabinet is not quiescent but normally is in motion; and the presence of an operator near the face, and of apparatus inside the working space, generate turbulent wakes which destroy the uniformity and laminarity of the flow.

In the design of the best fume cabinets, great care is taken, with a variety of flow control devices, to achieve a uniform inlet velocity at the face in the absence of an operator. The face velocity is the central feature in most fume cabinet specifications and is typically about 0.5 meters per second. With such fume cabinets very low contaminant concentrations are achieved in practice outside the face under ideal conditions However when conditions become non-ideal, e.g. in the presence of a turbulent wake produced by a manikin, the distance required between source and measurement point to achieve a reduction in concentration of six orders of magnitude is about 20 centimeters, as compared with 1 millimeter for ideal laminar flow.

An even more serious non-ideal condition is external air movement, which, if it exceeds 50 per cent of the face velocity, can drastically reduce the containment of the fume cabinet. Thus, cross flows at the face of the order of about 0.25 metres per second are too large to be tolerated by most conventional fume cabinets. However such speeds can commonly be produced by personnel traffic, ventilating flows, open doors and windows, and the like.

An entirely different approach to containment is the air curtain principle. In this concept, "face velocity" becomes irrelevant since containment is based on the property of the air curtain as a barrier to mass transport. So far as is known, there are currently no fume cabinets marketed using the air curtain principle. However a form of such fume cabinet was described in German Offenlegungrschrift 29 17 853 published Nov. 6, 1980. In this cabinet, a curtain of air is directed upwardly at the face opening, to prevent contaminants inside the cabinet from reaching the outside. As will be explained later in this description, the applicant has determined that the air flows used in the German document are insufficient to prevent spill-back of contaminated curtain air into the room at the top of the face opening.

As will be explained, certain minimum exhaust air flows are needed to provide reasonable assurance that the curtain will not spill back such contaminated air. The minimum flow needed is found, surprisingly, to be considerably more than that which might have been expected. However it is still less than that of many conventional counterflow fume cabinets, and it provides better resistance to crosswinds.

The use of an air curtain to protect an operator from harmful fumes while permitting the operator to have access to a working space was also described in British patent 1,582,438 published Jan. 7, 1981 to Imperial Chemical Industries Ltd. However in that patent, the air curtain together with noxious gases from the process are removed via a flue, and there is no indication of the flows required to prevent or reduce the likelihood of migration of contaminants through the curtain. As will be discussed, the ratio of exhaust to jet flows for a given range of curtain jet height to thickness ratio is important in order to improve the barrier properties of the curtain.

SUMMARY OF THE INVENTION

Accordingly, it is an object of the present invention to provide a fume cabinet having an air curtain arranged to provide improved isolation between its working space and outside. In one of its aspects the present invention provides an air curtain fume cabinet comprising:

(a) a set of walls including upper and lower walls, defining a working space, b) said walls further defining a face opening which allows access to said working space, (c) air jet supply means associated with said lower wall for supplying an air curtain jet extending across said face opening and lengthwise to the top of said face opening, (d) exhaust means associated with the top of said face opening for receiving said air curtain jet, (e) said exhaust means including means for exhausting substantially (i) the entire flow of said air curtain jet, plus (ii) all of the air which said air curtain jet entrains at least from outside said face opening, plus (iii) a substantial quantity of additional air from outside said face opening, thus to increase the velocity of air from outside said face opening moving into said jet adjacent the top of said face opening beyond the entrainment velocity that would normally be produced by the action of said jet alone, thereby to reduce the likelihood of spillback of air from said jet into the space outside said working space from the top of said jet, and thereby to improve the resistance of said air curtain jet to mass transfer thereacross in the presence of disturbing cross winds.

In another aspect the invention provides a method of providing an air curtain barrier across the face opening of a fume cabinet having a working space accessed through said face opening, said method comprising directing an air curtain jet from one side of said face opening across said face opening to an opposing side thereof, and providing an exhaust flow at said opposing side to exhaust substantially (i) the entire flow of said air curtain jet, plus (ii) all of the air which said jet entrains from outside said face opening, plus (iii) a substantial quantity of additional air from outside said face opening, thus to increase the velocity of air from outside said face opening moving into said jet from outside said face opening adjacent said opposing side of said face opening beyond the entrainment velocity that would normally be produced by the action of said jet alone, thereby to reduce the likelihood of spillback of air from said jet to outside said face opening.

Further objects and advantages of the invention will appear from the following description, taken together with the accompanying drawings.

DETAILED DESCRIPTION OF PREFERRED EMBODIMENT

Figure 1:
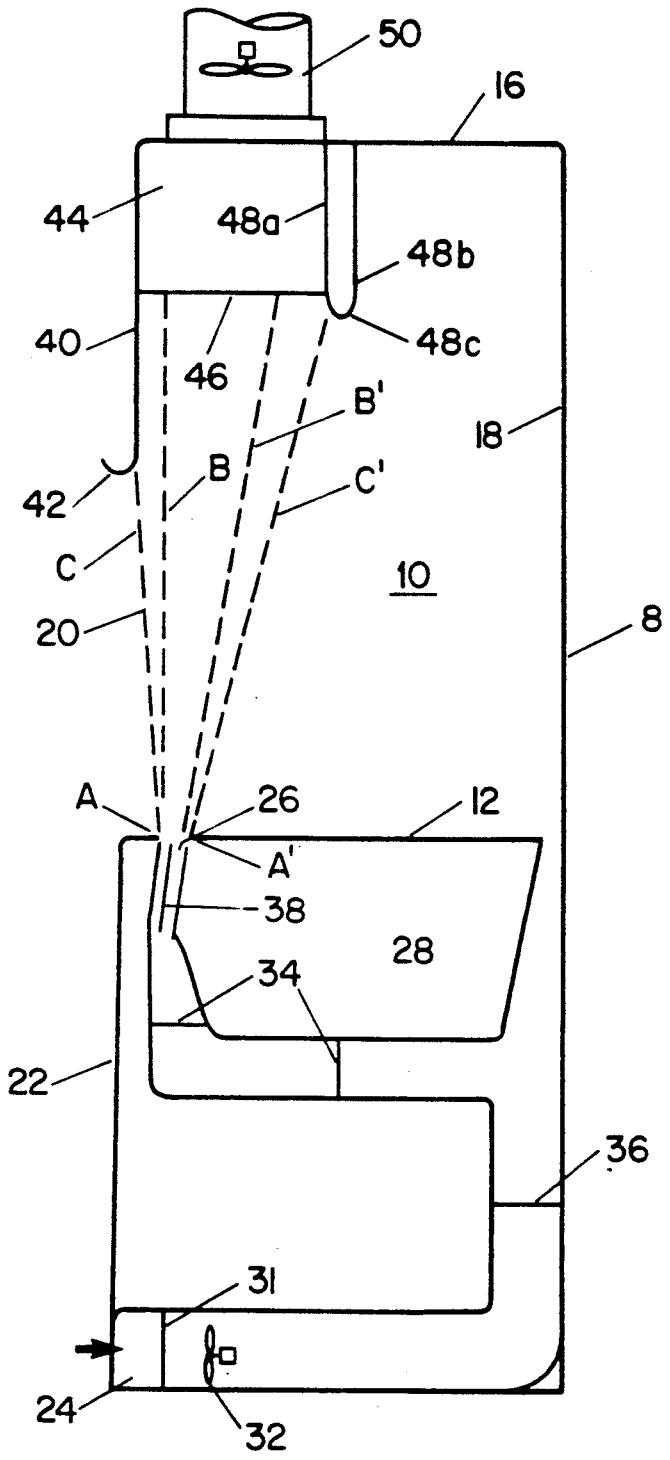
FIG. 1 is a side sectional view of a fume cabinet according to the invention.
Figure 2:
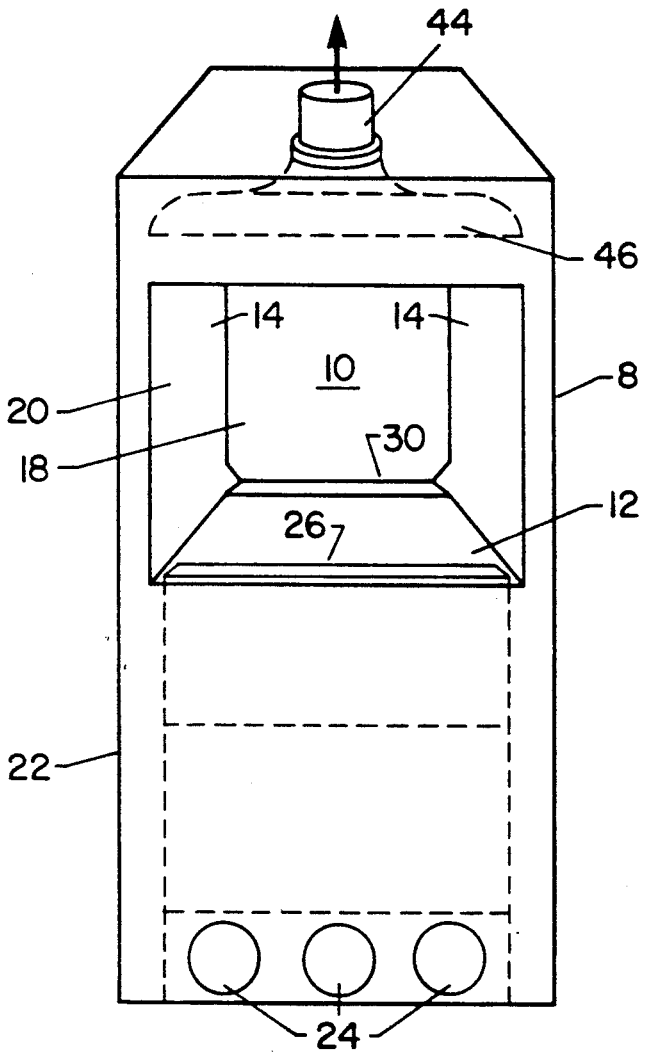
FIG. 2 is a front view of the cabinet of FIG. 1.

Reference is first made to FIGS. 1 and 2, which show a fume cabinet 8 according to the invention. As shown, the fume cabinet includes a working space 10 defined by a lower surface 12, side walls 14, a top 16 and a back 18. At the front of the working space 10 there is a "face" or access opening 20.

The lower surface 12 is defined by the top of a base generally indicated at 22. The base 22 includes an air inlet duct 24 which extends to the back of the base 22 (so that the front portion of the base 22 can be used for storage). The duct 24 then bends upwardly and then extends forwardly and upwardly to an exit slot 26 which extends across substantially the entire width of the face 20 at the front of the lower surface 12. A secondary and smaller duct 28 branches from the duct 24 and is directed to the rear of the cabinet where it joins a smaller slot 30 extending across the rear of the lower surface 12.

Air is drawn into the duct 24 through air filters 31 by several (e.g. three) conventional fans 32, passes through cleaning and flow smoothing screens 34, 36, and exits through slots 26, 30. One or more plates 38 may be placed parallel to the flow in slot 26 to smooth and direct the flow.

A sash 40 extends downwardly from the front of the top surface 16 to control the size of the face or opening 20. The sash 40 is moveable up and down in conventional fashion (by means not shown) to allow adjustment to the height of opening 20. The sash 40 has an outwardly and upwardly turned lip 42 for a purpose to be described.

Just inside the sash 40, at the front of the opening 10, is a wide exhaust duct 44. Duct 44 has an intake slot 46 which extends across substantially the entire width of the working space 10 and which has a substantial front to rear dimension. The rear wall 48 of the duct 44 is formed as a double wall having sheets 48*a*, 48*b* joined by a smooth curve 48*c*, for a purpose to be described. Exhaust air is drawn from the exhaust duct 44 by an exhaust fan 50.

If desired, the rear ventilation of the cabinet can be omitted by eliminating secondary duct 28 and slot 30. This arrangement is shown in FIG. 3, in which primed reference numerals indicate parts corresponding to those of FIGS. 1 and 2.

It will be seen that slot 26 slants rearwardly. This is because the air curtain issuing from slot 46 is wider at its top than at its bottom, and the arrangement shown is convenient to have exhaust duct 44 swallow the entire curtain, including all the air which it entrains at least at its front, as will be explained. However the rearward slant is not necessary since the curtain will bend to accomodate itself to the flows Q' and Q'' (which flows will be described).

Figure 3:
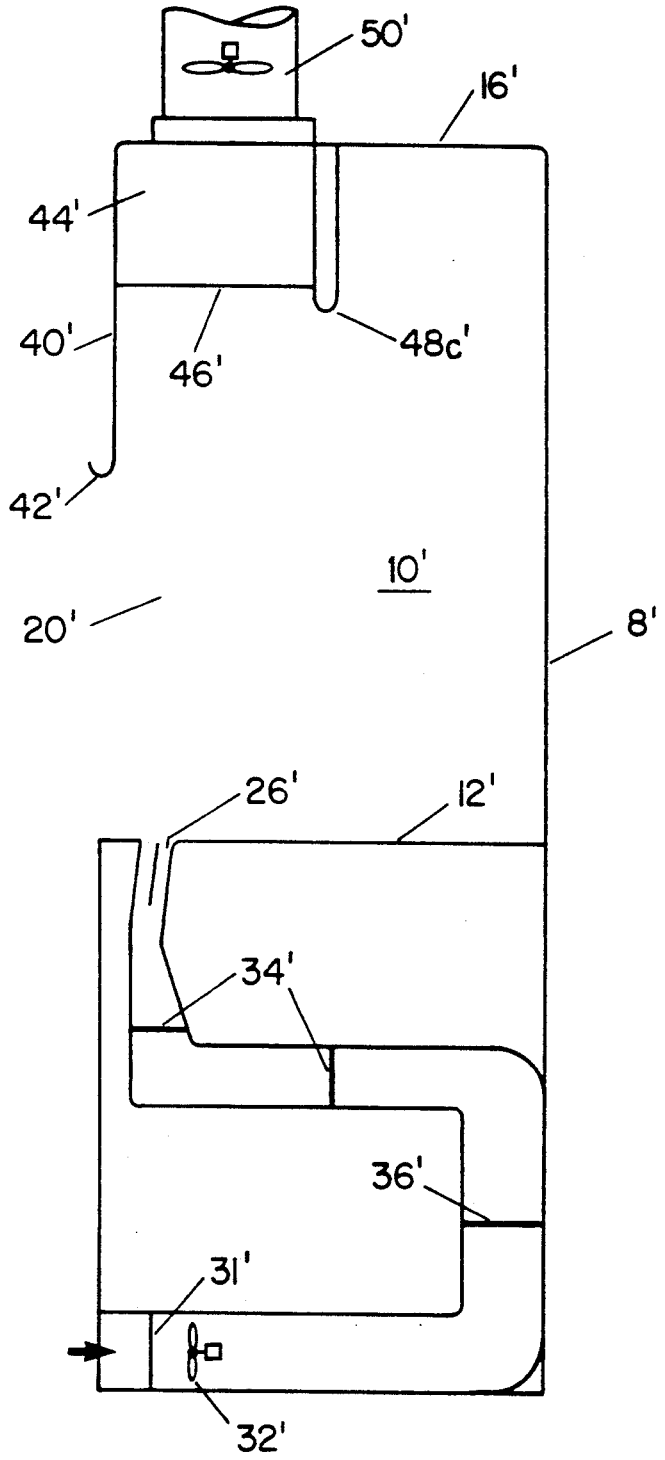
FIG. 3 is a side sectional view of a fume cabinet similar to that of FIG. 1 but with the rear of the cabinet not ventilated.
Figure 4:
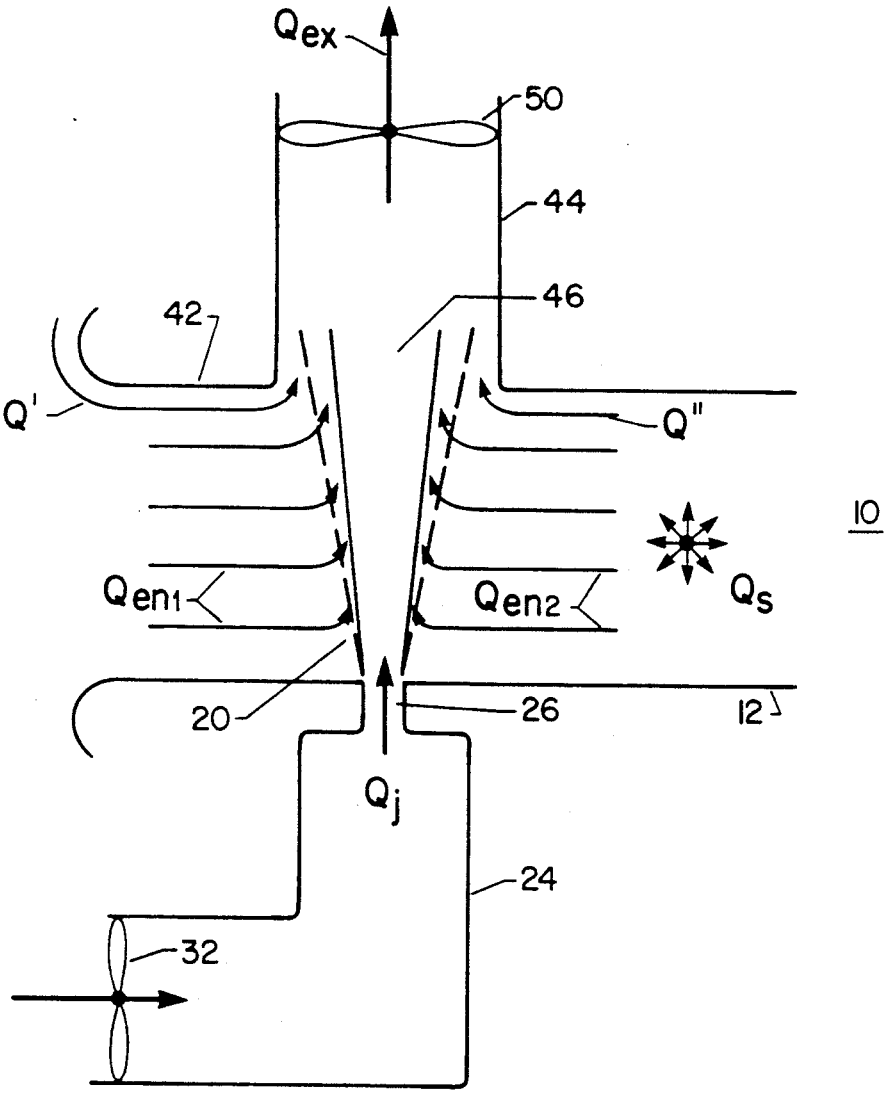
FIG. 4 is a diagram illustrating the air curtain principle.

The operation of the FIGS. 1 to 3 fume cabinets will best be understood from the following description. Reference is first made to FIG. 4, which illustrates the air curtain principle. FIG. 4 diagrammatically depicts duct 24, slot 26, and duct 44 with its intake slot 46. In FIG. 2 the following symbols are used:

$Q_j$ represents the air curtain jet flow supplied through slot 26 by fan 32.

$Q_{ex}$ represents the exhaust flow drawn by exhaust fan 50.

$Q_S$ represents the flow from a contaminant source S.

$Q_{en1}$ represents the air flow entrained into the jet from outside the space 10.

$Q_{en2}$ represents the air flow entrained into the jet from inside the space 10.

Q' and Q'' represent air flows drawn into the exhaust at the top of the opening 20, from inside and outside the space 10 respectively, for the situation where the flow exhausted $Q_{ex}$ is greater than that required simply to swallow the jet Q and its entrained air.

The above flows may be expressed in any appropriate units, e.g. cubic feet per minute (cfm) or liters per minute (l/m) or cubic meters per hour ($m^3/h$)

The exhaust flow is then $$Q_{ex}=Q_{ex1}+Q_{ex2}+Q'+Q''+Q_s \quad (1)$$

As indicated, equation (1) allows for more air (Q' and Q'') to be exhausted than is required simply to swallow the jet $Q_j$ and its entrained air. As will be explained, $Q_{ex}$ must be large enough so that Q' is greater than zero, if no curtain air is to be spilled back into the face 20.

Figure 5:
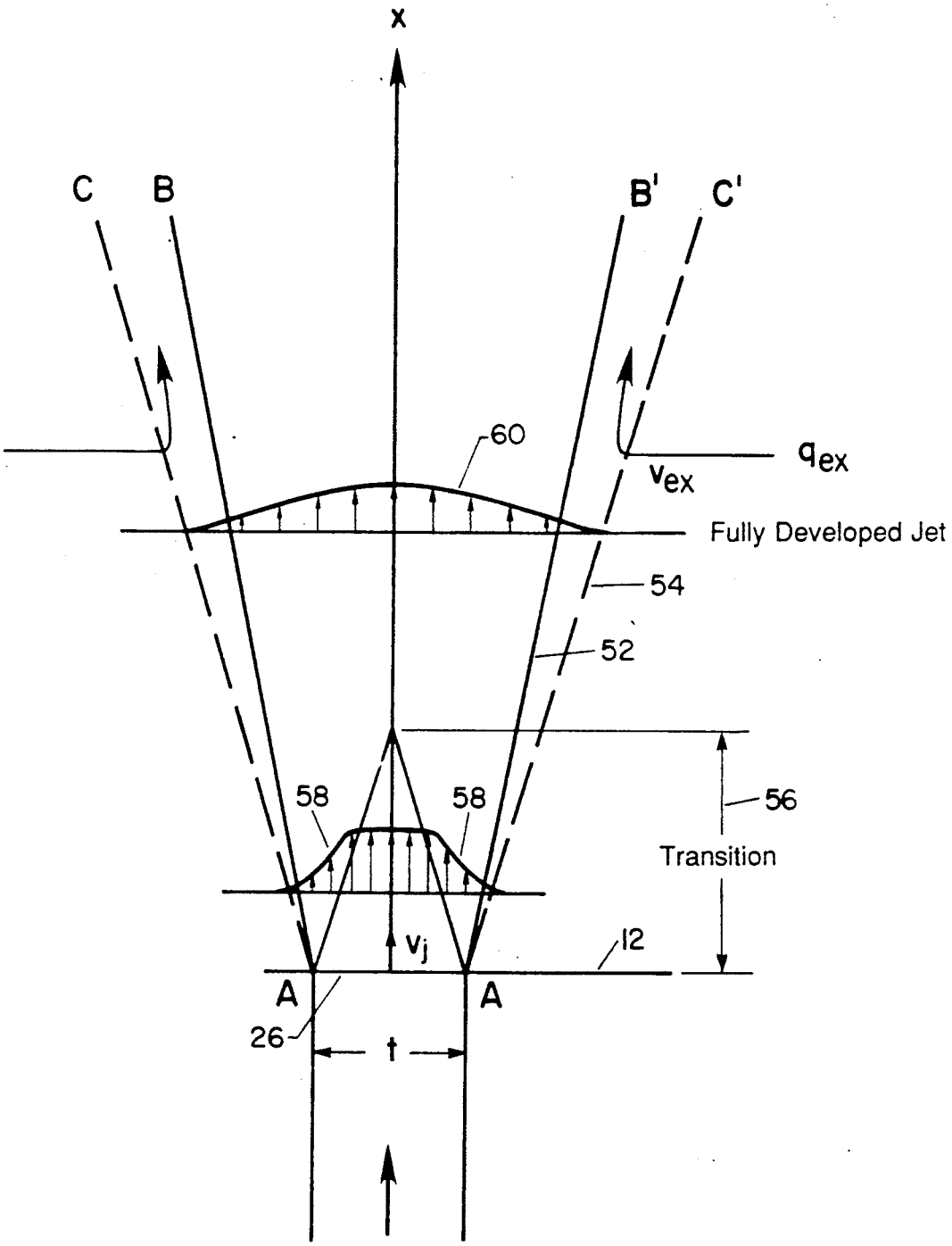
FIG. 5 is a diagram illustrating the structure of a jet sheet.

Some of the properties of an ideal jet sheet are illustrated in FIG. 5, which shows the jet of FIG. 4 in more detail. FIG. 5 shows a laminar jet sheet 52 of thickness t issuing from slot 26 into still air with a uniform initial velocity $v_j$. AB and A'B' are the dividing streamlines, i.e. the average streamlines that contain the original jet flow. Since the original jet flow is $Q_j$, thus the flow contained between the two lines AB and A'B' is $Q_j$ at all distances x measured above the bottom surface 12. Thus:

$$Q_j=v_j\, t\, w \quad (2)$$

where w is the width of the jet sheet 52. The dividing stream lines AB and A'B' have a precise mathematical definition and can be identified experimentally.

The lines AC and A'C' are the edges of the overall jet 54 and are not as well defined. The spaces between lines AB and AC, and between A'B' and A'C', contain the air entrained into the jet from each side of the jet. The entrainment process is primarily turbulent in nature. From some distance away, the jet can be perceived as a sheet sink, drawing air inwardly, the inwardly drawn air having a velocity vector approximately perpendicular to the jet axis (as shown in FIG. 4). The jet edge (i.e. lines AC and A'C') can be defined as the location at which the x-component of velocity becomes appreciable. The jet edge can be approximately located with smoke or tufts.

If the entrainment velocity is $v_{en}$, and the entrained incremental flow is $q_{en}$, (volume/unit time/unit x) from each side, and if Q(x) denotes the total jet flow at station x, then:

$$\frac{dQ(x)}{dx} = 2q_{en} \quad (3)$$

and $$q_{en} = v_{en}\, W \quad (4)$$

As shown in FIG. 5, when the issuing jet 52 is laminar and uniform, there is a transition zone 56, typically about 3t in length, during which the uniform velocity $v_j$ is eroded from both sides, as shown at 58 in FIG. 5. Beyond the transition zone 56 a cosine-squared sort of profile, indicated at 60, is reached in the fully developed flow.

An estimate of the amount of air entrained can be obtained from data given in a text entitled "The Theory of Turbulent Jets" by G. N. Abramovich, MIT Press, 1963, Library of Congress CAT. No.63-21743. If $Q_{en}$ is the total entrainment from one side between the exit of the jet from slot 26 and station x, then from the information given in the above Abramovich reference it can be deduced that:

$$\text{for } x/t<4.5,\ Q_{en}/Q_j=0.036(x/t) \quad (5)$$

$$\text{for } x/t > 7,\ Q_{en}/Q_j = .5(.53\sqrt{x/t} - 1) \quad (6)$$

$$\text{and } Q(x)=Q_j+2\,Q_{en} \quad (7)$$

where Q(x) is the total flow (jet plus entrained air) at station x.

It will be seen from equations (6) and (7) that at x/t=15, $Q(x)/Q_j=2$. Thus, it will be seen that entrainment generates a large increase in the total flow in the jet. The actual entrainment velocity can be estimated as follows.

From equations (7) and (3)

$$\frac{dQ_{en}}{dx} = q_{en} \quad (8)$$

and from equations (5) (6) and (2)

$$\text{for } x/t<4.5,\ dQ_{en}/dx=0.036\, Q_j/t=0.036 v_j w \quad (9)$$

$$\text{for } x/t>7,\ dQ_{en}/dx=0.133\, Q_j/t\, (x/t)^{-\frac{1}{2}}=0.133 v_j w\, (x/t)^{-\frac{1}{2}} \quad (10)$$

By equating (8) to (9) and (10) in turn, and using (4) we get $$\text{for } x/t<4.5,\ v_{en}/v_j=0.036 \quad (11)$$

$$\text{for } x/t>7,\ v_{en}/v_j=0.133\, (x/t)^{-\frac{1}{2}} \quad (12)$$

Thus, the entrainment velocity is estimated as being about one thirtieth of the original jet velocity near the jet exit, and diminishing with distance from the exit.

Figure 6:
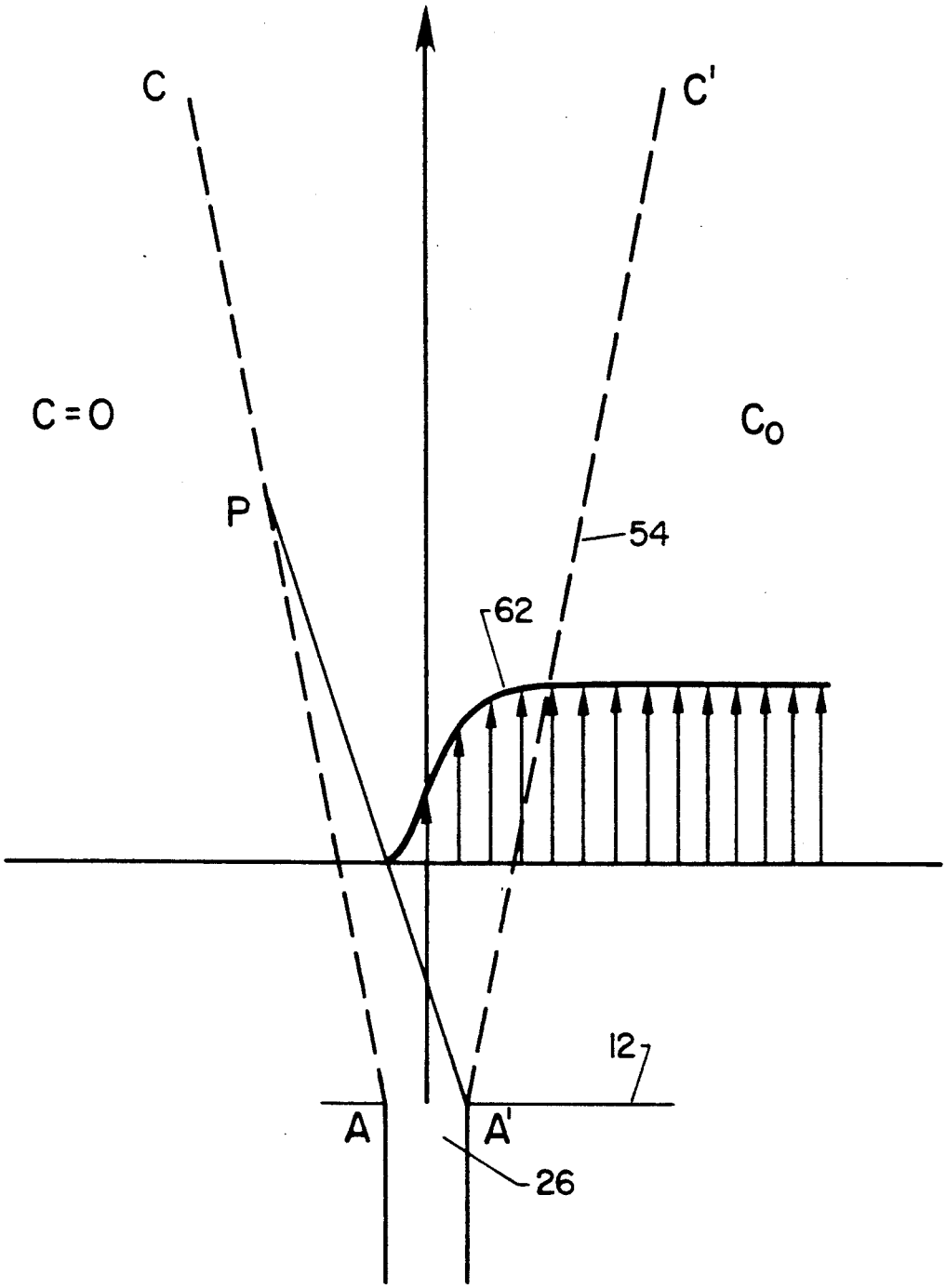
FIG. 6 is a diagram showing concentration profiles.

The mass transfer characteristic of the described air curtain is illustrated in FIG. 6. Assume that on the right hand of the jet 54 the concentration of a species S is maintained at $C_O$, that the region to the far left has concentration C=0, and that the air in the jet issuing from the slot is also free of species S. The concentration profile will then be qualitatively as shown as 62 in FIG. 6, falling from concentration $C_O$ on the right to essentially zero at a line AP. At locations above P, the concentration to the left hand side of the jet is greater than zero and is governed there by the entrainment velocity $v_{en}$ and by the counterflow principle. For example if the original jet velocity $v_j$ is about three metres per second, and x/t at P is 10, then the entrainment velocity $v_{en}$ is about 0.05 metres per second, about 1/10 of the usual face velocity. The fall off of concentration in upstream diffusion is proportional to the stream velocity, so the distance for a decrease of six orders of magnitude in a 0.05 meter per second stream may typically be 2 centimeters instead of 1 millimeter. While this appears to be a deterioration in performance, it will be realized that in actual use, laminar diffusion results are not representative. In regions such as the wake of an operator, an increase in the mean flow velocity external to the wake would result in an increase in the turbulent velocities and an expected increase in forward diffusion of the contaminant.

The performance of the fume cabinet shown in FIGS. 1 and 2 will now be discussed in more detail. In the FIGS. 1 and 2 cabinet, the jet 52 will issue from the slot 26, travel up the face 20, and will with its entrained air enter the exhaust slot 46 from which it is removed by exhaust fan 50. The air entrained into the jet 52 from inside the working space 10 is replaced by the auxiliary air flow issuing from duct 28 through slot 30. Assume that this auxiliary air flow is $Q_a$. Also assume that the flow of contaminant into the working space 10 from a contaminant source S is $Q_s$.

Then the average concentration Co of contaminant in the working space is $$C_o = \frac{Q_s}{Q_a} \tag{13}$$

Equation 13 will be valid provided that there is no recirculation of the curtain air into the cavity, i.e. provided that there is no spill back of air from the curtain into the cavity. This requires that Q'' be greater than or equal to zero or that the auxiliary flow $$Q_a \geqq Q_{en2} \tag{14}$$

For the example $x/t=15$, equation (14) yields:

$$Q_a \geqq 0.5 Q_j.$$

With the minimum value of the auxiliary flow $Q_a$, the average concentration in the working space is then $$C_o = \frac{2Q_s}{Q_j}$$

With a jet flow of, for example, 200 cfm (5660 l/m), and a contaminant flow $Q_s=4$ l/m (a typical representative test condition), then the concentration of contaminant from source S in the working space 10 is $$C_o = 2 \times \frac{4}{5660} = .00141 = 1410 \text{ ppm.}$$

The calculation of 1410 ppm applies when just sufficient air is supplied in the auxiliary jet from slot 30 to replace the air entrained in the jet from the working space 10, so as to avoid spill back.

In the FIG. 3 arrangement, where no auxiliary air is supplied to the working space 10, the flow Q'' of FIG. 4 is zero and the inner dividing streamline attaches at its upper end to the inner lip 48C of the exhaust duct 44. All the air entrained by the lower portion of the curtain is then spilled back at the top of the curtain into the working space 10 (since the air removed from the working space 10 must be replaced). This sets up a vigorous recirculating flow or vortex in the working space 10, in which the concentration of species or contaminant S builds up to relatively high values. An equilibrium value is attained when the rate of diffusion of species S past the dividing streamline is equal to $Q_s$ (i.e. the flow of species S out of space 10 equals the flow of species S into space 10). However despite the relatively high internal concentration, this arrangement was shown by experiment to provide satisfactory containment, although not as good as that achieved by the FIGS. 1 and 2 arrangement.

The resistance of the curtain to disturbing air cross currents of speed $v_d$ in the room will now be discussed. In such consideration, the governing parameter is the disturbance velocity $v_d$ divided by the jet velocity, i.e. $v_d/v_j$. One would expect serious interference with the containment to occur at or above a critical value of this ratio. Since the jet velocity $v_j$ diminishes with height above the exit slot 26, and this reduction itself depends on x/t, i.e. on the jet slot width, then the critical ratio $v_d/v_j$ will also depend on the jet width. The applicant's experiments have shown that both the height of the face opening 20, and the exhaust flow $Q_{ex}$, are important parameters in fixing the critical ratio $v_d/v_j$ at which containment disruption occurs. Thus, once the design value of the disturbance velocity $v_d$ is chosen, the design value of the jet velocity $v_j$ will follow, and so in turn will jet flow $Q_j$, the auxiliary flow $Q_a$, and the exhaust flow $Q_{ex}$.

Figure 7:
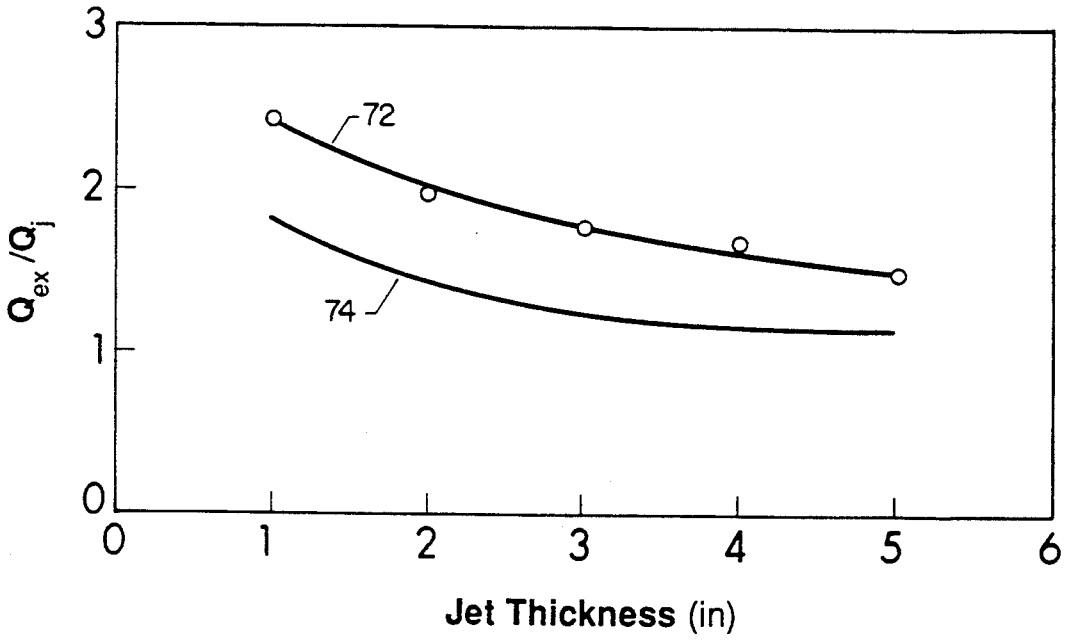
FIG. 7 is a graph showing ratios of minimum exhaust flow to curtain flow for attached flow.

Experiments were carried out to establish the general character of the flow field and to determine the ratio $Q_{ex}/Q_j$ that would ensure smooth continuous inflow at the lip 42 at the top of face opening 20 in the absence of any disturbing cross flows. In other words, the objective was to see whether observations agreed with the previously described theory concerning what ratio of exhaust flow $Q_{ex}$ to jet flow $Q_j$ was needed to prevent spillback to the outside at the top of the air curtain. In the experiments lip 42 formed part of a vertically movable sash (as is conventional for fume cabinets) so that the height of the face opening 20 can be adjusted. The jet thickness (i.e. the front to back dimension of slot 26) was varied, and the ratio of $Q_{ex}/Q_j$ needed to prevent spillback to the outside of lip 42 was observed, using tufts of fibre attached to the bottom of lip 42. The results are shown in FIG. 7 for a face opening of 26 inches. The measured results are indicated by curve 72 and are much higher than the estimates of $Q(x)/Q_j$ obtained from equations (5), (6) and (7), which are indicated by curve 74 for comparison in FIG. 7.

The reason why the actual exhaust flow needed to prevent spillback to the outside is much higher than the theoretical exhaust flow needed, is believed to be as follows. The theoretical or calculated flow is simply the exhaust flow needed to swallow the jet, plus the air entrained into the jet from outside the working space 10, all on a time averaged basis. However in fact the jet produces some turbulence, and the turbulence produces momentary localized flow reversals. To prevent these reversals, a substantially higher exhaust flow is needed than that necessary simply to swallow the jet and the air entrained into the jet from outside the working space 10. Thus, a substantially higher exhaust flow than would otherwise be necessary, is required to ensure smooth continuous inflow at lip 42 from outside the face opening 20. This was in the absence of disturbing cross-flows. As will be shown, if there are disturbing cross-flows, then an even higher exhaust flow $Q_{ex}$ will be helpful in preventing spill back in the presence of such cross-flows.

Figure 8:
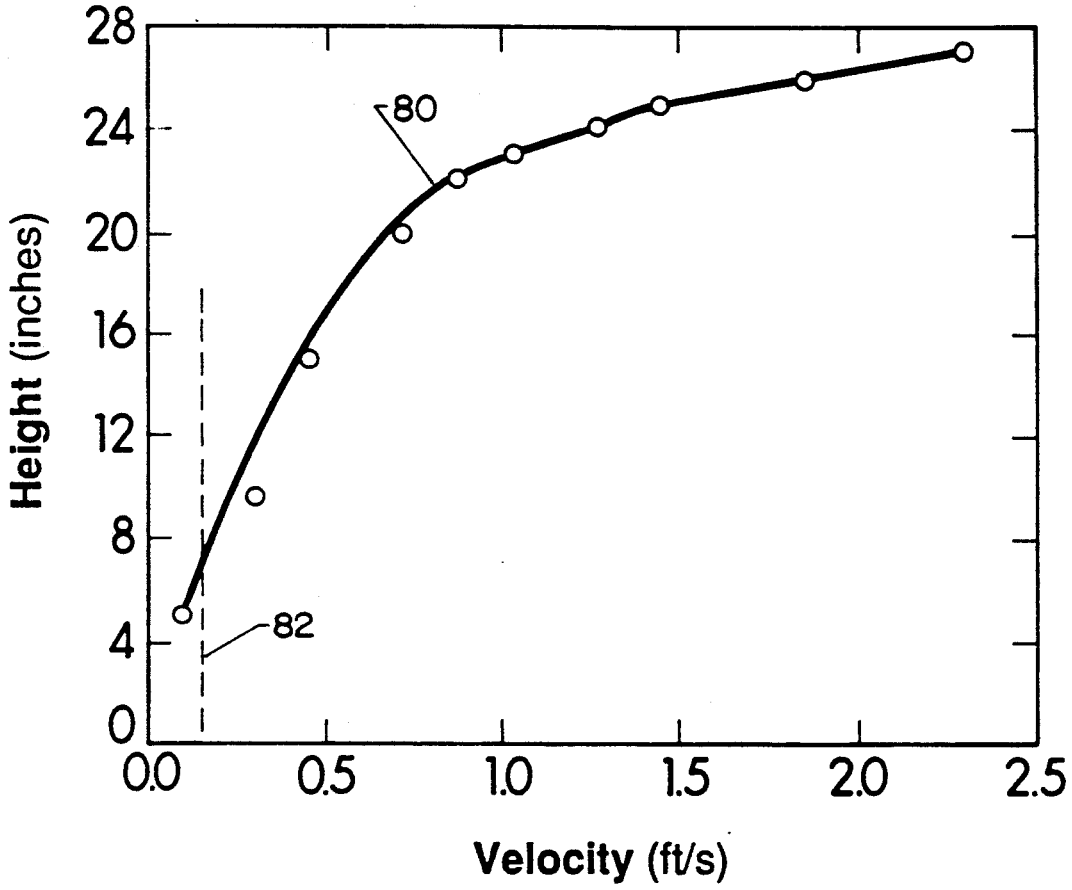
FIG. 8 shows air velocity in front of the air curtain, plotted against height.

FIG. 8 illustrates the impact on velocity distribution when an exhaust flow $Q_{ex}$ of the magnitude indicated by curve 72 of FIG. 7 is used. To produce FIG. 8, the velocity of the air inflow into the curtain or jet 54 from outside, was measured at the centre of the face opening 20, just in front of the curtain, and at varying heights above the lower surface 12. The resulting curve is shown at 80 in FIG. 8 and is plotted for a three inch thick air curtain (i.e. slot 26 was 3 inches thick). A jet flow of 230 cfm was used, and the average value of $v_j$ was 4.97 feet per second at the exit slot 26. The exhaust flow $Q_{ex}$ was 550 cfm so $Q_{ex}/Q_j=2.4$.

From equation 11 one would expect an entrainment velocity of about 0.18 feet per second (fps) near the bottom of the jet, and this velocity is shown in dotted lines at 82 in FIG. 8. The actual measured velocity is indeed of this order of magnitude at the lower portion of the curtain, but increases to much larger values as the top of the opening 20 is approached even though equation (12) shows that the entrainment decreases with height. The higher flow velocities near the top of the curtain are produced because the exhaust flow $Q_{ex}$ in the example given is substantially larger than that needed merely to swallow the jet flow $Q_j$ and to swallow the air outside face 20 which would normally be entrained by the jet flow. In effect, there is substantial extra flow Q' (FIG. 4) at the top of the face opening 20. The extra flow Q', which may in a sense be considered to be a "line sink" (since it is relatively small in vertical dimension) is responsible for the higher velocities there, and is highly beneficial in controlling both the concentration of contaminants at the outside of the face opening 20, and the resistance of the air curtain to cross drafts.

Figure 9:
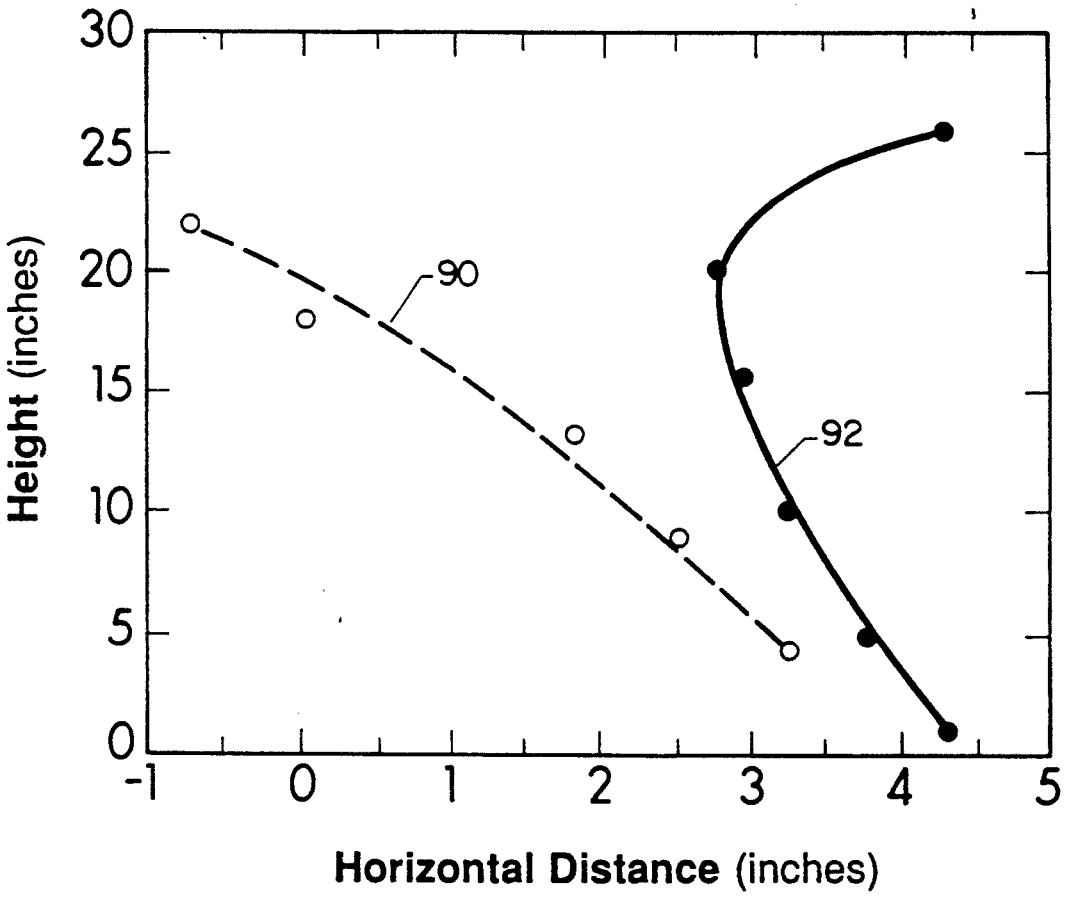
FIG. 9 is a graph showing profiles of a specific test gas concentration measured against horizontal distance from the source, at two exhaust flows.

The beneficial effect of the extra flow Q' on concentration distribution is illustrated in FIG. 9. For FIG. 9 a "contaminant" source of helium was provided with a flow of 1 cfm. The jet velocity $Q_j$ was 230 cfm and the jet thickness was 2 inches. The helium source was located approximately 12 inches inside the working space 10 as measured from the left side of the slot 26, and was ½ inch above lower surface 12. In FIG. 9 horizontal distance is plotted on the horizontal axis, with the origin or zero being at the left side of slot 26. Positive distances are measured inside the work space 10, and negative distances are distances to the left of the working space (as drawn), i.e. outside the face 20. The vertical axis shows the height in inches above the lower surface 12.

In FIG. 9, curve 90 shows the shape of a low concentration contour (14 ppm of helium) when $Q_{ex}$ was 440 cfm and $Q_e/Q_j$ has a value of 1.9. Curve 92 shows the 14 ppm helium concentration contour when $Q_{ex}$ was 550 cfm and $Q_{ex}/Q_j$ has a value of 2.4.

It will be noted that curve 90 ($Q_e/Q_j=1.9$) is at about the lower limit for acceptable flow, and that any lower ratio would result in too much contaminant migrating past the face. However when the ratio $Q_{ex}/Q_j$ is 2.4, the 14 ppm helium concentration profile 92 stays well inside the face or opening 20. Thus the effect of increasing the exhaust flow $Q_{ex}$ in reducing concentration at the face is seen from FIG. 9 to be quite dramatic.

Figure 10:
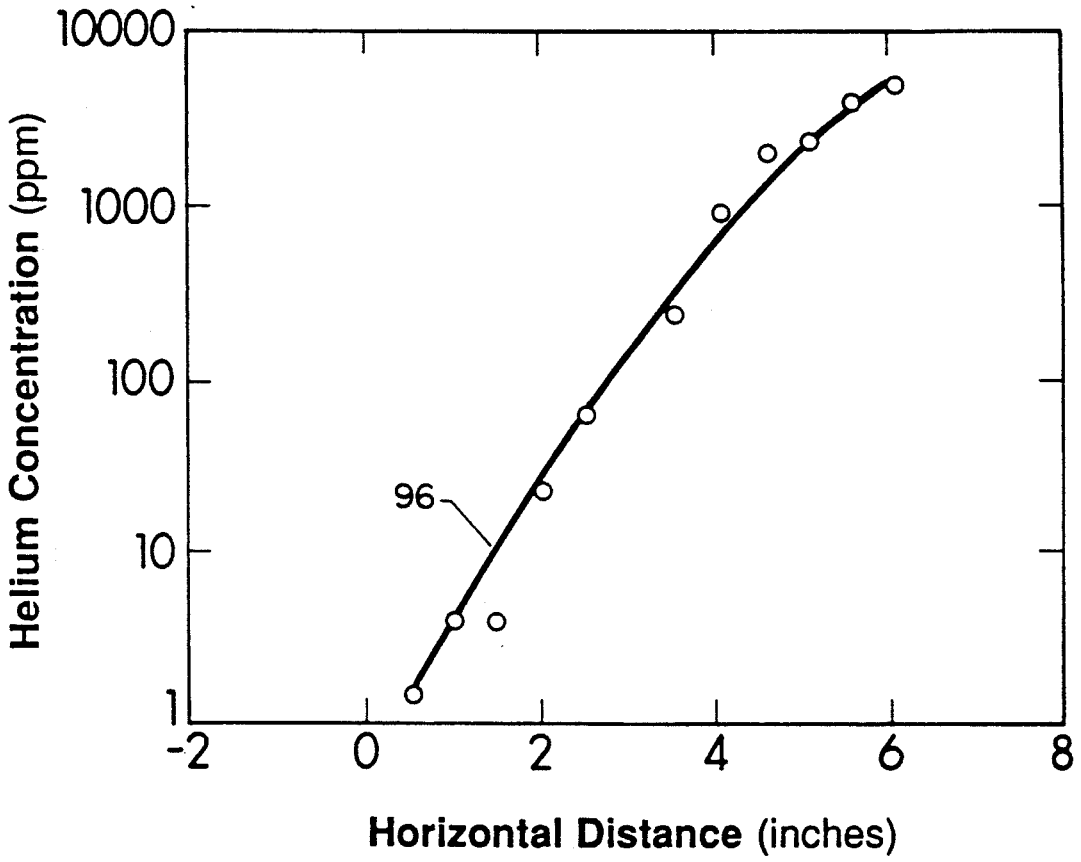
FIG. 10 is a graph of test gas concentration versus horizontal position.

FIG. 10 is a plot made by moving a helium concentration measuring probe through the curtain at a height 13 inches above the lower surface 12, for the air curtain used for FIG. 9 and with the exhaust flow $Q_{ex}=550$ cfm. In FIG. 10, again horizontal distance from the left side of slot 26 is shown on the horizontal axis, as in FIG. 9. Helium concentration in parts per million is shown on the y axis. It will be seen from curve 96 that as expected, the helium concentration near the face was very low. This indicated that with the ratio $Q_{ex}/Q_j=2.4$, little or no helium was migrating across the curtain.

Figure 11:
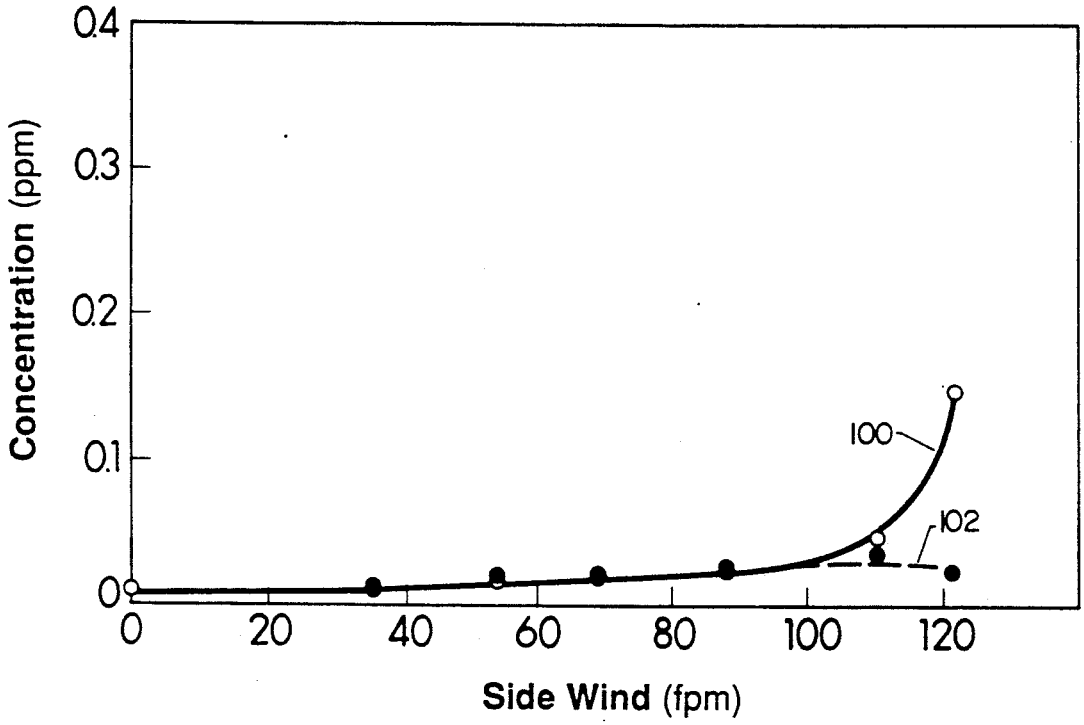
FIG. 11 is a graph showing the variation of test gas (contaminant) concentration variation with side wind speed for the FIG. 1 fume cabinet.
Figure 12:
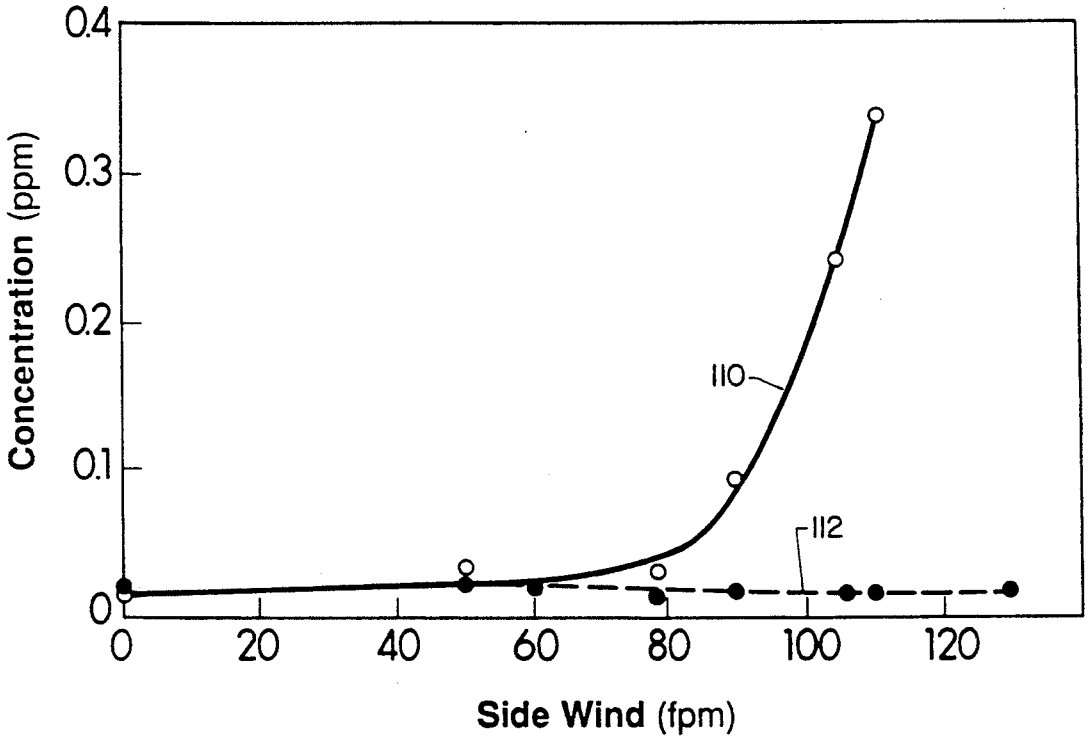
FIG. 12 is a graph similar to that of FIG. 11 but for the fume cabinet of FIG. 3.

FIGS. 11 and 12 illustrate the benefits on resistance to cross flows of having the ratio $Q_{ex}/Q_j$ substantially greater than the theoretically calculated ratio (based on average flows needed to ensure no spillback to the outside of the curtain). To produce FIGS. 11 and 12, SF6 was used as a test or contaminant source gas. In both FIGS. 11 and 12 the cross wind speed is shown in feet per minute on the horizontal axis, and the contaminant concentration in ppm on the y axis. FIG. 11 shows results for the FIG. 3 version of the invention (no auxiliary ventilation of the working space 10), with an exhaust flow $Q_{ex}=600$ cfm and a jet flow $Q_j=230$ cfm ($Q_{ex}/Q_j=2.6$). Curve 100 shows the result with a face opening of height 27 inches, and curve 102 shows the result when the face opening was 21 inches. The concentration was measured where the face of a person would be, using the ASHRAE standard for reporting. For FIG. 11 the measurements were taken without a manikin, but where the manikin's face would be located, i.e. about 2 inches outside the curtain and a the height of the manikin's face.

It will be seen that with zero cross wind, the contaminant concentration at the manikin's face was measured as being 0.018 ppm. This level can be achieved by a conventional fume cabinet under ideal conditions. As the velocity of the cross wind increased, the contaminant level increased only very slightly, until the cross wind velocity reached 110 fpm. Then, at a face opening height of 27 inches, a very large increase in contaminant concentration at the manikin's face occurred, as indicated by curve 100. However, when the face height was reduced to 21 inches (curve 102), a cross wind of 120 fpm (the limit of the test equipment used) was unable to produce any breakdown in the curtain. The contaminant concentration at the manikin's face remained very low.

An even better result appears from FIG. 12. The FIG. 12 measurements were taken using a manikin, and using the FIGS. 1 and 2 arrangement, i.e. the working space was ventilated with auxiliary air from duct 28. In FIG. 12, two curves 110, 112 were plotted, both for a face opening height of 27 inches. For curve 110 the exhaust flow $Q_{ex}$ was 500 cfm, and for curve 112 $Q_{ex}$ was 700 cfm. In both cases, the jet flow was $Q_j=230$ cfm, so $Q_{ex}/Q_j$ was 2.2 for curve 110 and was 3 for curve 112. The auxiliary flow $Q_a$ was sufficient to replace air entrained into the jet from inside space 10 and was approximately 110 cfm.

In the absence of crossflow, an exhaust flow $Q_{ex}$ of 500 cfm produced a contaminant level at the face of the manikin of 0.012 ppm. When the exhaust flow $Q_{ex}$ was increased to 700 cfm, the contaminant level at the face of the manikin fell to 0.005 ppm, which is very low.

When the cross wind velocity increased to 90 fpm, the contaminant level increased substantially for curve 100 (i.e. for $Q_{ex}=500$ cfm). However, for $Q_{ex}=700$ cfm (curve 112), a cross wind velocity of more than 120 fpm (the limit of the apparatus used) failed to produce any increase in the contaminant concentration at the location of a manikin's face. It will be seen that with sufficient exhaust flow, $Q_{ex}$ the device is extraordinarily resistant to disruption by cross winds.

Thus in summary, it is important that the exhaust flow $Q_{ex}$ be sufficient to swallow not only the jet and the air which would normally be entrained by it, but also to swallow some additional air, to produce higher entrainment velocities at the top of the face that would normally occur by reason of the jet alone. The ratio $Q_{ex}/Q_j$, for the ratio curtain height to jet thickness x./t up to approximately 30, is preferably between 2 and 3, and preferably between 2.4 and 3. Where the curtain is higher ($x/t>30$) or where cross winds may be particularly severe, the ratio $Q_{ex}/Q_j$ can be greater than 3, but if it is too high, more air will be exhausted (which must be cleared and which carries room heat) than is needed. However it is noted that an exhaust flow of 700 cfm is relatively low as compared with that used in a conventional counterflow fume cabinet, where the exhaust flows are typically in the region 1000 to 1200 cfm.

The invention will particularly be appreciated by comparison with that shown in German Offenlegungschrift 29 17 853 (supra), and particularly FIG. 6 thereof. The German document shows an air curtain fume hood having an air curtain jet of flow $Q_j = 100\ m^3/h$. There is also direct air and gas injection of 100 $m^3/h$, of which 6 $m^3/H$ is air for a burner which is supplied with a flammable gas at the rate of 1 $m^3/h$. The air curtain is shown as entraining 100 $m^3/h$ from outside the working space and 50 $m^3/h$ from inside the working space. An additional .boosting flow of 80 $m^3/h$ is added at the top of the air curtain and total exhaust flow from the top of the air curtain is shown as 330 $m^3/h$. From the rear of the working space, 50 $m^3/h$ is separately exhausted.

By scaling FIGS. 2 and 12 of the drawings (which are dimensioned), it was determined that the width of the jet exit slit (corresponding to slit 26 in the applicant's disclosure) is about 4 mm. Since the face opening is given (FIG. 7) as 0.9 m, thus the ratio of the curtain is $$x/t = 900/4 = 225$$

By contrast, the applicant's ratio x/t is typically about 15.

Using data from the Abramovich reference (supra), the entrainment into each side of a jet having x/t equal to 225 is:

$$\frac{Q_{en}}{Q_j} = 1/2(.530\sqrt{x/t} - 1)$$

For a jet flow of $Q_j = 100\ m^3h$ and $x/t = 225$, this yields:

$$Q_{en} = 348\ m^3/h.$$

In other words, an air curtain of the height shown would try to ingest or entrain 348 $m^3h$ of air from each side. The air (100 $m^3/h$) shown as being entrained in the jet from outside is far less than that needed to provide the air curtain with the air it needs, and the exhaust flow is also far less than that required to exhaust this volume of air. The consequence is a spillback of contaminated curtain air into the room at the top of the opening.

By contrast, the applicant's arrangement ingests significantly more air through the face than the above theoretically calculated entrainment, in order to help ensure smooth continuous inflow at the lip 42 despite momentary localized flow reversals caused by occasional intermittent bursts of turbulence.

It is important that the exhaust fan 50 always be on when the inlet fan 32 is on. Therefore, if desired a conventional interlock can be provided, to ensure that if the exhaust fan 50 is not on, then the inlet fan 32 cannot be on.

Normally the flow provided by the exhaust fan 50 should be between 2 and 3 times that provided by the inlet fan 32 for flow $Q_j$ (as discussed). If desired, and to ensure that failure of the exhaust system cannot create an unsafe operating condition, monitoring devices (not shown) can be provided in conventional manner to monitor the flows and to shut off the curtain fans 32 if the exhaust fan 50 is unable to provide the required ratio of flows. Alternatively, both fans can be on a single shaft operated by a single motor, as shown in the German document, although additional duct work would be required in such an arrangement. In addition, such an arrangement would not deal with the possibility that the exhaust duct may become partly obstructed.

Additionally, it is within the state of the art to provide a sensor attached to the moveable sash, which can be used to control either or both of the exhaust and curtain flows, in order to maintain them at the magnitudes and in the ratio appropriate to the sash opening.

It will be realized that the fume cabinet of the invention may be supplied without its own exhaust fan and may instead be connected to the building or laboratory exhaust fan. In that case, the air flow required for the fume cabinet exhaust will of course be specified so that the necessary exhaust flow is achieved.

While a preferred embodiment of the invention has been described, it will be appreciated that modifications and other embodiments may be used, and all are within the scope of the appended claims.

I claim:

1. An air curtain fume cabinet comprising:

(a) a set of walls including upper and lower walls, defining a working space, (b) said walls further defining a face opening which allows access to said working space, (c) air jet supply means associated with said lower wall for supplying an air curtain jet extending across said face opening and lengthwise to the top of said face opening, (d) exhaust means associated with the top of said face opening for receiving said air curtain jet, (e) said exhaust means including means for exhausting substantially (i) the entire flow of said air curtain jet, plus (ii) all of the air which said air curtain jet entrains at least from outside said face opening, plus (iii) a substantial quantity of additional air from outside said face opening, thus to increase the velocity of air from outside said face opening moving into said jet adjacent the top of said face opening beyond the entrainment velocity that would normally be produced by the action of said jet alone, thereby to reduce the likelihood of spillback of air from said jet into the space outside said working space from the top of said jet, and thereby to improve the resistance of said air curtain jet to mass transfer thereacross in the presence of disturbing cross winds.

2. Apparatus according to claim 1 and including auxiliary air flow means for supplying auxiliary air into said working space to replace air entrained into said jet from inside said working space.

3. Apparatus according to claim 2 wherein said walls include a rear wall at the rear of said working space and said auxiliary air flow means includes a slot adjacent said rear wall and lower wall to introduce auxiliary air into said working space at the lower rear corner thereof.

4. Apparatus according to claim 2 wherein the ratio of the flow exhausted by said exhaust means to the flow of said jet ($Q_{ex}/Q_j$) is at least 2 where the ratio of the height of said face opening to the thickness of said jet is not greater than about 30.

5. Apparatus according to claim 4 wherein said ratio $Q_{ex}/Q_j$ is between 2 and 3.

6. Apparatus according to claim 4 wherein said ratio $Q_{ex}/Q_j$ is between 2.4 and 3.

7. Apparatus according to claims 1, 2 or 3 and including a smoothly outwardly and upwardly turned lip at the top of said face opening.

8. Apparatus according to claims 1, 2 or 3 and including a smoothly outwardly and upwardly turned lip at the top of said face opening, and wherein said exhaust means includes an exhaust duct extending downwardly into said working space from said upper wall, said exhaust duct having a rear duct wall, said rear duct wall having a smoothly curved lip at its lower end to guide air smoothly into said exhaust duct from inside said working space.

9. A method of providing an air curtain barrier across the face opening of a fume cabinet having a working space accessed through said face opening, said method comprising directing an air curtain jet from one side of said face opening across said face opening to an opposing side thereof, and providing an exhaust flow at said opposing side to exhaust substantially (i) the entire flow of said air curtain jet, plus (ii) all of the air which said jet entrains from outside said face opening, plus (iii) a substantial quantity of additional air from outside said face opening, thus to increase the velocity of air from outside said face opening moving into said jet from outside said face opening adjacent said opposing side of said face opening beyond the entrainment velocity that would normally be produced by the action of said jet alone, thereby to reduce the likelihood of spillback of air from said jet to outside said face opening.

10. A method according to claim 9 and including the step of providing a flow of auxiliary air into said working space to replace air entrained into said jet from inside said working space.

11. A method according to claim 10 wherein, when the ratio of jet length to jet thickness is not greater than about 30, the ratio of said exhaust flow to the flow of said jet ($Q_{ex}/Q_j$ is at least 2.

12. A method according to claim 11 wherein said ratio $Q_{ex}/Q_j$ is between 2 and 3.

13. A method according to claim 11 wherein said ratio $Q_{ex}/Q_j$ is between 2.4 and 3.

14. A method according to any of claims 9 to 13 wherein said one side of said face opening is the bottom of said face opening and said opposing side of said face opening is the upper side of said face opening.

* * * * *